United States Patent [19]

Siemon et al.

[11] Patent Number: 4,944,698

[45] Date of Patent: Jul. 31, 1990

[54] DUAL MODULAR JACK ADAPTER

[75] Inventors: John A. Siemon, Watertown, Conn.; Richard Early, San Diego, Calif.

[73] Assignee: The Siemon Company, Watertown, Conn.

[21] Appl. No.: 290,033

[22] Filed: Dec. 27, 1988

[51] Int. Cl.[5] ..... H01R 23/02

[52] U.S. Cl. ..... 439/676; 439/144; 439/638; 439/701

[58] Field of Search ..... 439/154, 188, 638, 676, 439/701, 709, 712, 715, 716, 718, 719, 174, 460, 144

[56] References Cited

U.S. PATENT DOCUMENTS

| | | | |
|---|---|---|---|
| 4,241,974 | 12/1980 | Hardesty | 439/676 |
| 4,552,423 | 11/1985 | Swengel, Jr. | 439/188 |
| 4,655,521 | 4/1987 | Thomas | 439/174 |

*Primary Examiner*—Neil Abrams
*Assistant Examiner*—Khiem Nguyen
*Attorney, Agent, or Firm*—Fishman, Dionne & Cantor

[57] ABSTRACT

A dual modular jack adapter for insertion directly on a telephone terminal block of the type having a plurality of connectors extending therefrom (i.e., type 66 terminals) is presented. The dual modular jack adapter is comprised of a compact insulative housing having a plurality of apertures therethrough, each aperture leading to a cavity having a plurality of connector clips therein. The connector clips accessible on the front surface are preferably quick connect type connector clips held in place by a snap on connector clip carrier. The connector clips are connected via wire conductors, which enter through slots in the base of the snap on connector clip carrier, to dual standard modular jacks for access of test phones or other auxilliary equipment. The present invention may be configured for any size modular jack including 2, 4, 6 or 8 wire jacks. The whole unit can be assembled by snapping the separate pieces together.

23 Claims, 8 Drawing Sheets

DUAL MODULAR JACK ADAPTER

BACKGROUND OF THE INVENTION

This invention relates to a modular test adapter device for use in the telephonic and related industries. More particularly, this invention relates to a new and improved terminal block adapter which accesses the wiring of a telephone terminal block of the type having a plurality of connectors extending therefrom such as, for example type 66 terminals.

In the communications industry, and more particularly in the telephone industry, terminal blocks having a plurality of clip-type electrical connectors protruding therefrom are used. One such terminal block is the well known Type 66 quick connect block.

A typical prior art method of accessing the connections in a terminal block is to attach the wires leading from the electronic accessing apparatus to the electrical connectors of the block by individual spring clips. i.e. alligator clips. It will be appreciated that this is time consuming and is subject to human error. Thus, alligator clips of this type may create problems such as accidental shorting across terminals or intermittent connections.

Another prior art accessing apparatus involves a block which is the same size as the entire block to be accessed. This block has an array of contact elements that are force fitted over the connector elements of the terminal block. The block, once contact is made, is secured to the terminal block by clamping arms and a clamping screw which is torqued through the arms to load the block against the terminal block. This apparatus is bulky and cumbersome, both to mount and dismount. Furthermore, because of the force fit of contacts over the connector elements of the terminal block, contact can only be made with every third row of the connecting block because of space limitations. Thus individual rows cannot be accessed (the entire terminal block must be accessed as a unit).

Still another prior art device is disclosed in U.S. Pat. No. 4,293,174 which is assigned to the assignee hereof. U.S. Pat. No. 4,293,174 describes an assembly comprising a plurality of pistons and piston rods within a plurality of chambers, each piston being connected to a conductive grommet and a resilient conductive spring. The assembly is then mounted on protruding connectors or terminals of the type hereinabove discussed via the chambers wherein electrical contact between the pistons and terminals is effected. However, while the device disclosed in U.S. Pat. No. 4,293,174 is suitable for its intended purposes, it does not easily afford interconnection with standardized modular plugs; and it must be held in place during use.

Still another prior art device is disclosed in U.S. Pat. No. 4,585,290, which is also assigned to the assignee hereof and incorporated herein by reference. U.S. Pat. No. 4,585,290 describes a modular test adapter comprising a plurality of apertures having a U-shaped connector clip disposed within each aperture. Each connector clip is connected via conductive wire to a standard modular jack. While the modular test adapter disclosed in U.S. Pat. No. 4,585,290 is well suited for its intended purposes, it does suffer from certain drawbacks. For example, the test adapter of U.S. Pat. No. 4,585,290 is suited only for connection onto a vertical column of terminals; it does not mate with both columns and rows of terminals as is sometimes desirable. This adapter is also constructed to house only a single modular jack; and is not configured for use with multiple jacks. Also, this prior device requires screw or ultrasonic welding for its construction and is therefore relatively labor intensive and expensive to manufacture.

Yet another prior art device to be referenced is disclosed by U.S. Pat. No. 4,655,521 to Thomas, which is also assigned to the assignee hereof and which describes a multicomponent telephone block access system. This patent incorporates several important features including snap assembly and multiple row access. While suitable for its intended purposes, the system of U.S. Pat. No. 4,655,521 does suffer from certain drawbacks and limitations. For example, with snap assembly, this system is very difficult to handle because it does not lend itself to a progression of independent operations. Instead, it must be held in fixtures until the unit is complete.

A second drawback to the system of U.S. Pat. No. 4,655,521 is that the outside conductors are exposed rather than enclosed. This condition is undesirable from the viewpoint of potential electrical shorting between conductors due to misalignment or conductive debris. The narrow nose portion of this prior art connection also allows internal movement which may disturb the electrical connections between block and adapter. This disturbance may be manifested in the form of static on the voice or data lines which is acceptable for a test device connected in parallel, but not for a wiring accessory that is series connected. The final and most significant objection to U.S. Pat. No. 4,655,521 is that it cannot house two modular jacks while still maintaining its stackability on the terminal block.

SUMMARY OF THE INVENTION

The above discussed and other problems and deficiencies of the prior art are overcome or alleviated by the dual modular jack adapter of the present invention. In accordance with the present invention, a novel dual modular jack adapter is provided for insertion directly onto a telephone terminal block of the type having a plurality of terminals extending upwardly therefrom such as, for example, a type 66 quick connect terminal block.

The dual jack adapter of the present invention is comprised of a compact two-piece insulative housing having a plurality of apertures on its front surface arranged in two parallel rows or sets. The apertures lead into a main body cavity provided in the insulative housing. An important feature of the present invention is the provision of a snap-on clip carrier which is received within the main body cavity. The connector clip carrier is divided into cells. Each cell contains an insulation displacement connector clip and an opening to allow a conductive wire to pass into the cell and connect to the connector clip. The conductive wire connects the connector clips to two standard modular jacks.

Accordingly, when the dual jack adapter of the present invention is mounted onto the terminals of a connector block, the terminals are inserted through the apertures and into the main body cavity wherein the connector clips therein effect electrical and mechanical contact between the terminals of the block and the modular jacks. Thereafter a test phone or other auxiliary equipment having a standard modular plug may be used in conjunction with the present invention. Each row or set of apertures is connected or interconnected to any size modular jack including 2, 4, 6, or 8 wire modular jacks.

It will be appreciated that the parallel set of apertures allow the adapter of this invention to be inserted directly onto two parallel columns of terminals extending from the terminal block for access to two modular jacks in an end stackable configuration. This feature is in contrast to the prior art adapters of U.S. Pat. Nos. 4,585,290 and 4,655,521 and allows the testing of two columns of terminals with the insertion of one dual test adapter; or the interruptable bridging of one column of terminals with the next adjacent column.

The above discussed and other features and advantages of the present invention will be apparent to and understood by those of ordinary skill in the art from the following detailed description and drawings.

DESCRIPTION OF THE DRAWINGS

Referring now to the drawings, wherein like elements are numbered alike in the several FIGURES.

DESCRIPTION OF THE PREFERRED EMBODIMENT

Figure 1:
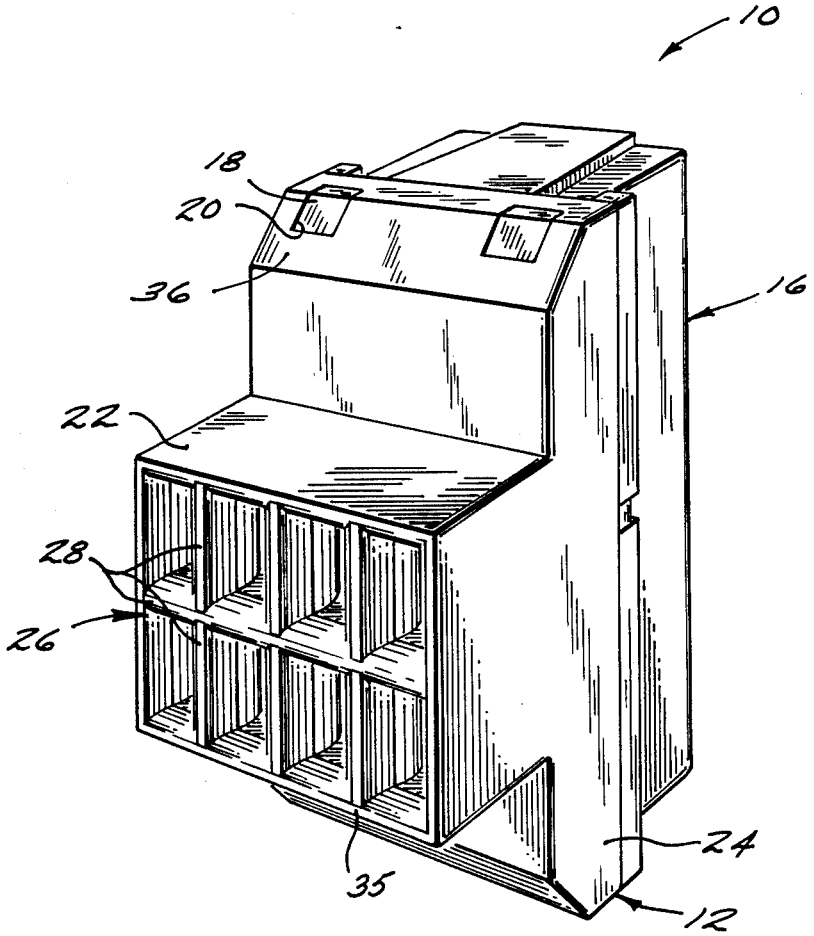
FIG. 1 is a front perspective view of the dual modular jack adapter in accordance with the present invention.

Referring jointly to FIGS. 1–3, 8 and 9, a dual modular jack adapter is shown generally at 10. It will be appreciated that while four wire, 8 position modular jacks are used in the preferred embodiment, any size modular jacks may be used with the present invention, including two, six and eight wire modular jacks.

Dual jack adapter 10 of the present invention is comprised of a front housing portion 12, an internal connector clip carrier 40 and a modular jack rear housing portion 16 detachably connected by snap action protrusions 18 to mating slots 20 in housing portion 12. Alternatively, housing portions 12 and 16 may be mated by any other configuration of protrusions; or by any other suitable means, including but not limited to ultrasonic welding and mechanical fasteners or the like. Both housing portions 12 and 16 are preferably comprised of a moldable insulating material such as any well known plastic material.

Front housing portion 12 has a T-shape formed by a plug ended nose 22 and a substantially rectangular base portion 24. Plug ended nose 22 includes a plurality of apertures 26 in a parallel 2×4 array. That is, apertures 26 are arranged in two parallel rows of four. Apertures 26 provide communication between the exterior and interior of housing 12. Plug ended nose 22 may be less than, equal to, or greater than the width of the base portion 24. The preferred embodiment has a nose 22 with a length equal to the width of base 24. It will be appreciated by those skilled in the art that the width of nose 22 and the thickness of aperture walls 28 are configured in accordance with the size of the terminals 30 extending from a selected terminal block such as the type 66 terminal block shown in FIG. 11. Of course, apertures 26 could have any other suitable dimensional configuration for any other selected terminal block. As is clear from a review of FIG. 11, nose 22 should have a depth which is greater than the height of a terminal 30 so as to permit base portion 24 to extend above and beyond the terminal block fanning strip 34 when the present invention is installed on terminal block 32. Alternatively, the necessary depth of nose 22 may be achieved by providing stops of sufficient height on the aperture face 35 of adapter 10.

Base portion 24 of housing 12 has a beveled corner 36 which provides a gripping surface for removal of adapter 10 from terminal block 32. The beveled corners also help to define latch recepticals 20 without leaving open gaps to the interior of the module that would be needed to accommodate latch flexure just prior to engagement. Alternatively, base portion 24 of housing 12 may have any other corner geometry including, but not limited to, square and round corners. Rear housing portion or modular jack housing 16 includes two modular jack ports 38 which are preferably incorporated into the modular jack housing as integral molded sections.

Figure 3:
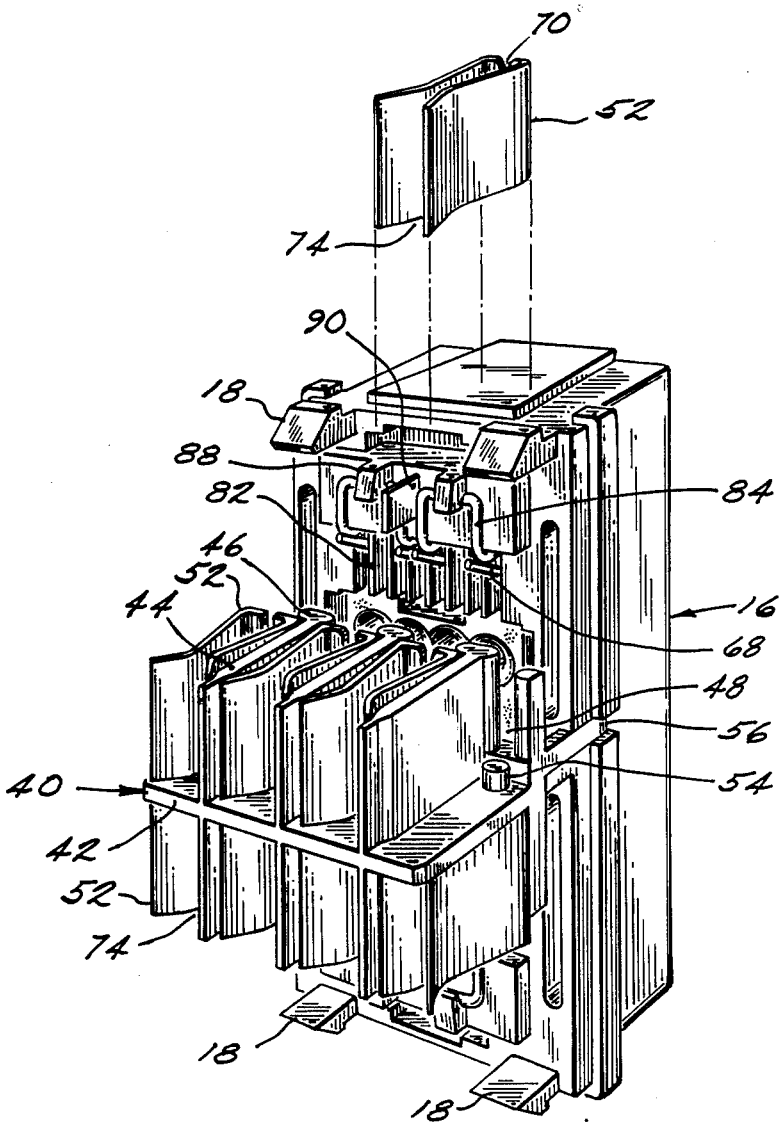
FIG. 3 is a front perspective view of the dual modular jack adapter of FIG. 1 with a portion of the housing removed.
Figure 7:
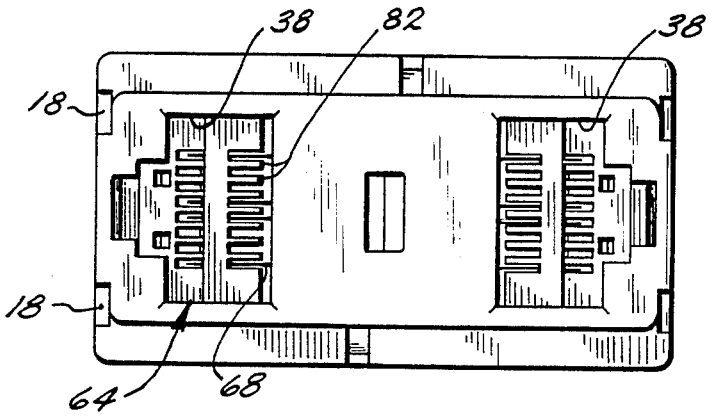
FIG. 7 is a rear elevation view of the dual modular jack adapter of FIG. 1.
Figure 6:
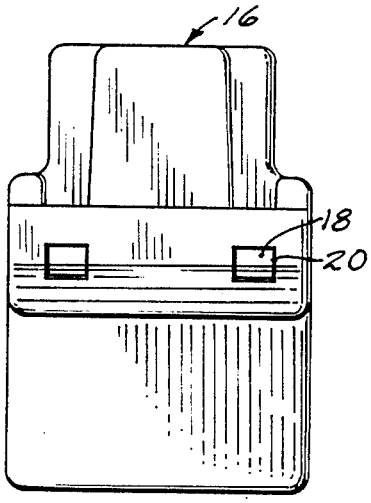
FIG. 6 is an end elevation view of the dual modular jack adapter of FIG. 1.
Figure 5:
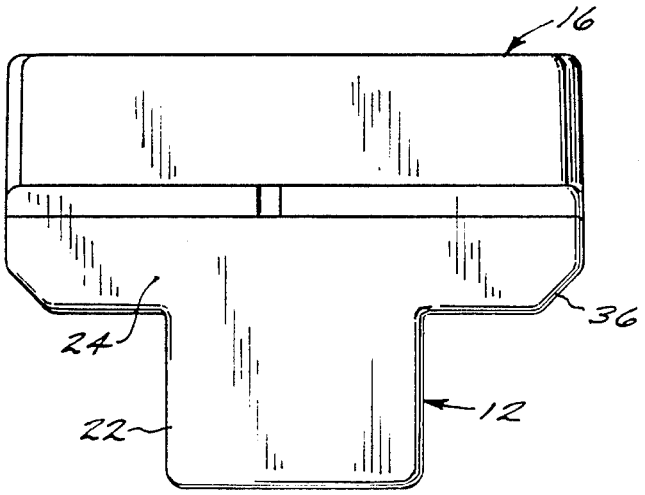
FIG. 5 is a side elevation view of the dual modular jack adapter of FIG. 1.
Figure 4:
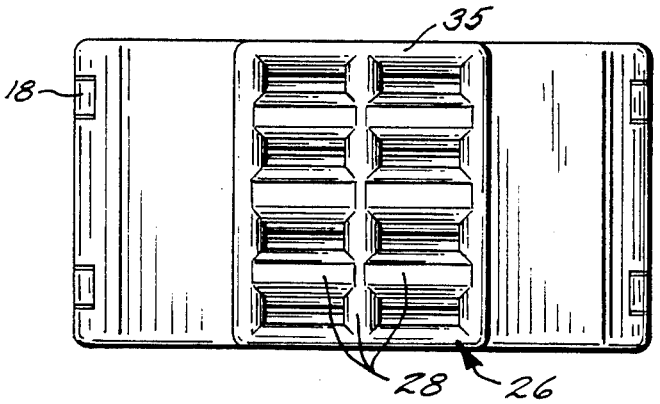
FIG. 4 is a front elevation view of the dual modular jack adapter of FIG. 1.
Figure 8:
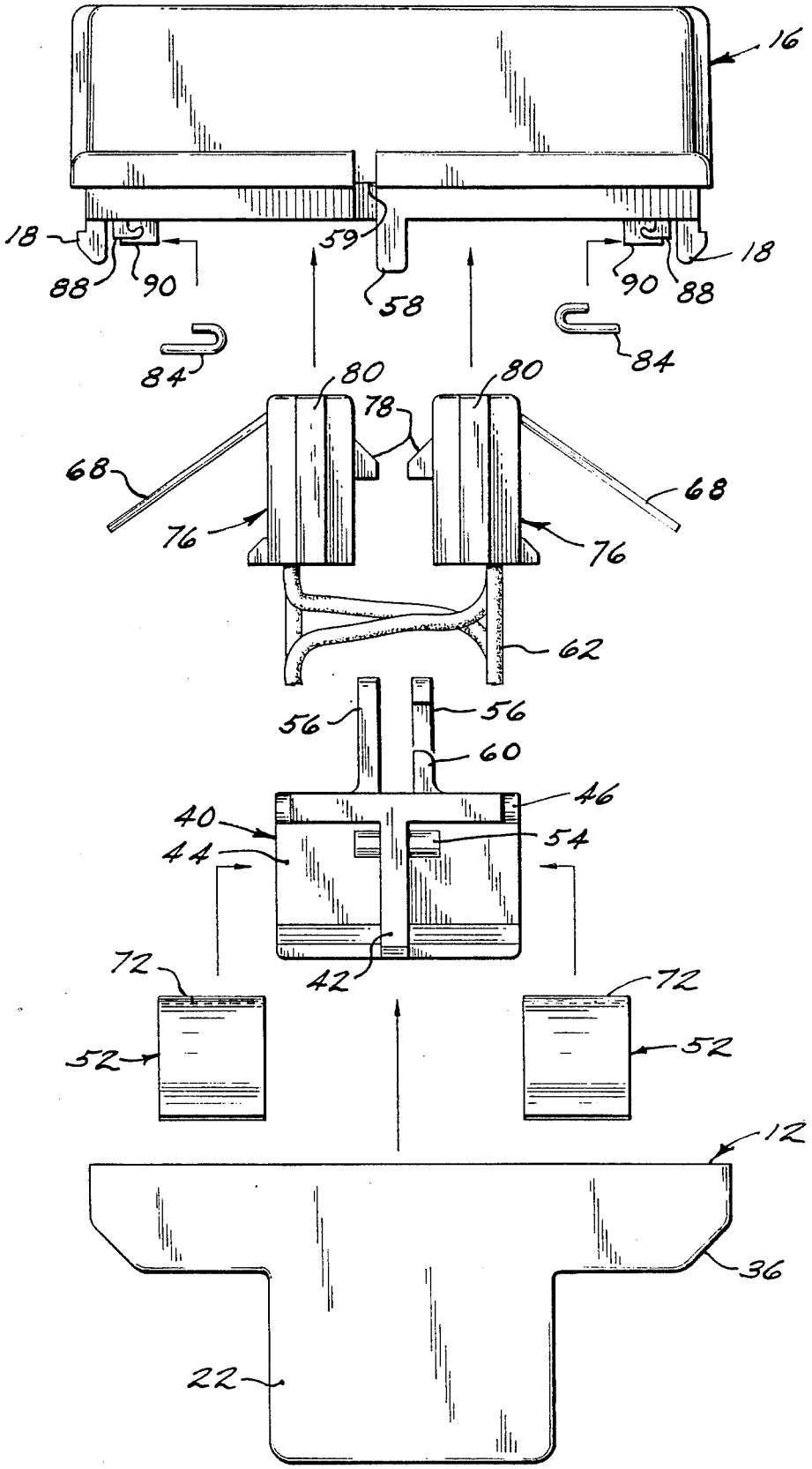
FIG. 8 is an exploded side elevation view of the dual modular jack adapter of FIG. 1.
Figure 9:
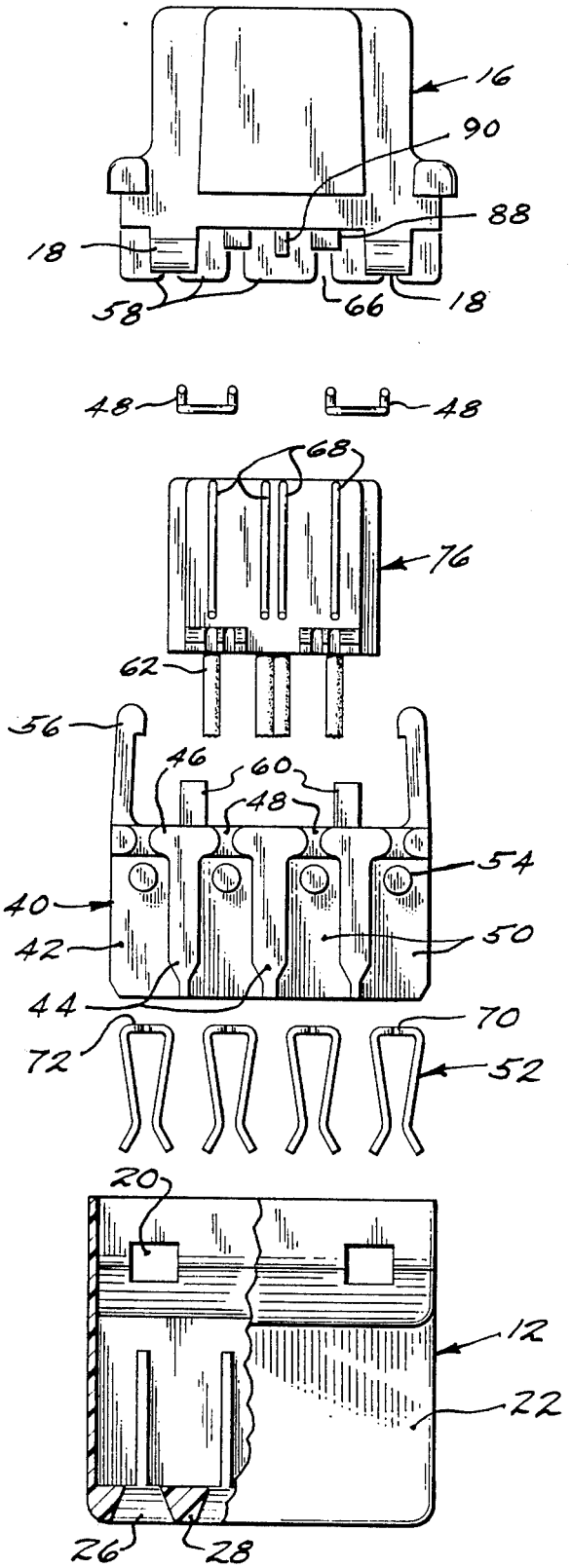
FIG. 9 is an exploded end elevation view of the dual modular jack adapter of FIG. 1.

The interior of dual modular jack adapter 10 is shown in FIGS. 3, 8 and 9. The interior comprises a main body cavity in housing portion 12 which surrounds a connector clip carrier 40. Carrier 40 includes a single central divider wall 42 and a plurality of transverse cell walls 44. The depth of walls 44 and divider 42 are such that the base of walls 44 and divider 42 are flush with the base of nose 22, while the top of walls 44 and 42 butt with the bottom of aperture walls 28 found within nose 22. Perpendicular to and extending from the base of both walls 44 and divider 42 are connector clip carrier base supports 46. Base supports 46 are coterminous with central divider 42 and walls 44. A gap 48 is defined between adjacent pairs of base supports 46 (see FIG. 9).

Carrier 40 includes a plurality of 2 sided and 3 sided cells 50 which are defined by walls 44, central divider 42 and base supports 46. Each cell 50 has disposed therein one connector clip 52. To maintain the position and alignment of connector clip 52, a stub 54 is molded into the floor of each cell 50. It will be appreciated that the base of each gap 48 is coterminous with the top of each stub 54. Stub 54 acts to preclude lateral movement by connector clips 52 after placement between the stub 54 and the base supports 46 of cell 50.

Carrier 40 is attached to modular jack housing 16 by a pair of resilient carrier hooks 56 which extend in an opposite direction from base supports 46, walls 44, and central divider 42. Carrier 40 rests on a plurality of opposed upstanding support members 58 which extend upwardly from modular jack housing 16. Carrier 40 has two depending location tabs 60 for aiding in location and attachment of carrier 40 to rear housing 16 by frictional interference with support members 58. Location tabs 60, in conjunction with support member 58 and hooks 56, lend lateral support to carrier 40 when it is hooked to housing 16 by stepped latch receptical 59.

Wire conductors 62 lead from each connector clip 52 to a well known standardized modular jack 64, wherein the conductors or wires 62 are connected to contact pins 68 within modular jack 64. As shown in FIG. 3, each connector clip 52 is the known "quick connect" type previously disclosed in U.S. Pat. No. 4,585,290 and is provided with insulation stripping slots 70. Stripping slots 70 are oppositely disposed from each other on clip base portion 72 and provide two stripping areas for each clip 52. Thus clip 52 will make electrical contact regardless of its orientation in cell 50. Connector clip 52 has a well known construction which includes a pair of oppositely disposed arms connected at a base and extending therefrom. The extended arms converge to a point where they diverge and terminate at an entrance section. Connector clip 52 provides a spring action closure for terminals 30 (FIG. 11) which are inserted between the divergent end or entrance 74 of clips 52.

Conductive wire 62 passes through slot 66 defined by support members 58 into the standard modular jack package 76. Package 76 is known and commercially available. Package 76 has a plastic housing which contains a slanted stop 78 on the sides of package 76 opposite pins 68, and rectangular guides 80 on the sides of the package 76 perpendicular to the side with pins 68. When modular jack package 76 is guided into modular jack housing 16, slanted stop 78 is pushed along the base of support member 58 until it reaches an open rectangle (not shown) in the base of support member 58. When fully seated, the opening and stop 78 are configured in a manner that prevents modular jack package 76 from movement.

Pins 68 of package 76 are placed between insulative fins 82 integrally molded into housing 16. While this is the preferred embodiment, a commercially available modular jack package complete with pins, insulative fins, and entrance ports can also be used. Fins 82 separate adjacent pins 68 from contacting each other and thus shorting out the system. Fins 82 also function as a guide for the proper alignment of the pins within modular jack port 38. When in a non-biased state (e.g. no modular plug inserted), pins 68 make contact with small bus bars 84 which complete the circuit formed by adapter 10 when inserted on a terminal block 32. In this way, dual modular adapter 10 will function as a bridging adapter to bridge a pair of laterally adjacent terminals. While the preferred embodiment utilizes bus bars 84 to allow the present invention to connect parallel terminal columns when not in service, the circuit can also be configured to prevent bridging of the columns of terminals as well by simply removing the bus bars. Bus bar 84 (shown more clearly in FIG. 9) is held in place by a small clip 88 integrally molded on housing 16. Bus bars 84 are separated from each other by a small stop 90 protruding from housing 16.

Figure 10:
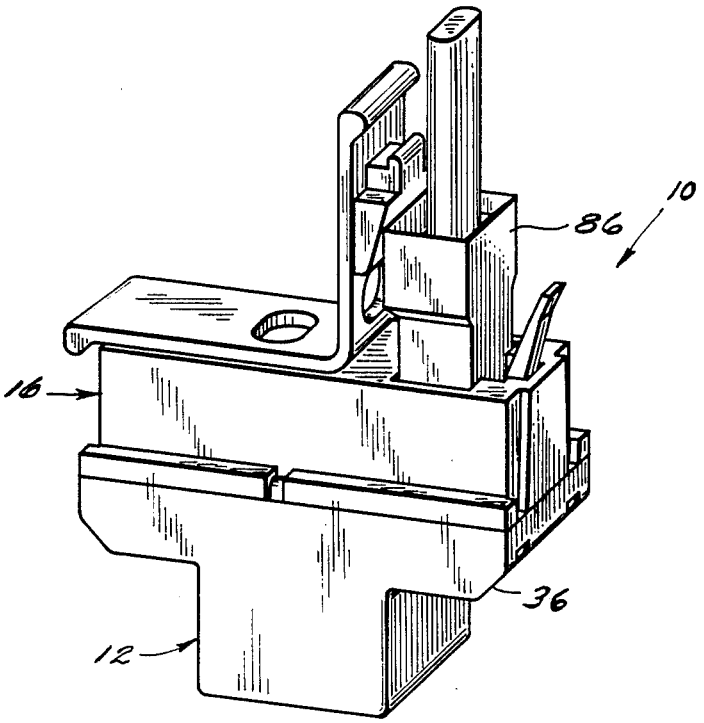
FIG. 10 is a rear perspective view of a modular plug inserted into the one of the modular jacks of the dual modular jack adapter of FIG. 1 equipped with a protective cover.
Figure 2:
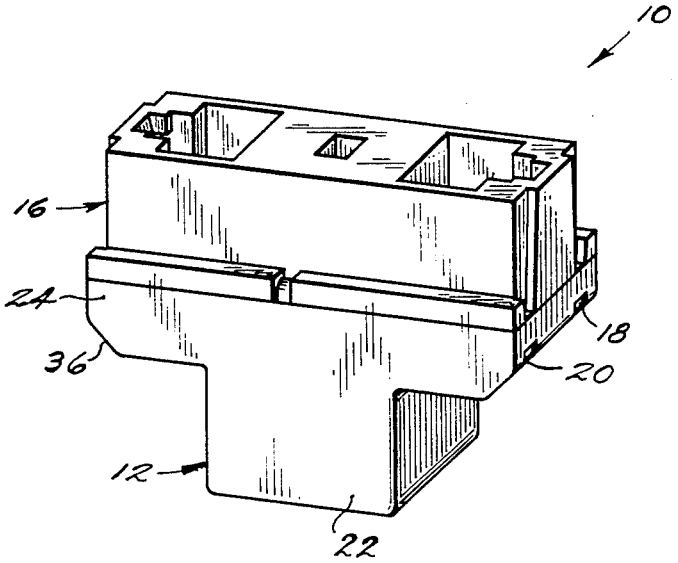
FIG. 2 is a rear perspective view of the dual modular jack adapter of FIG. 1.
Figure 12:
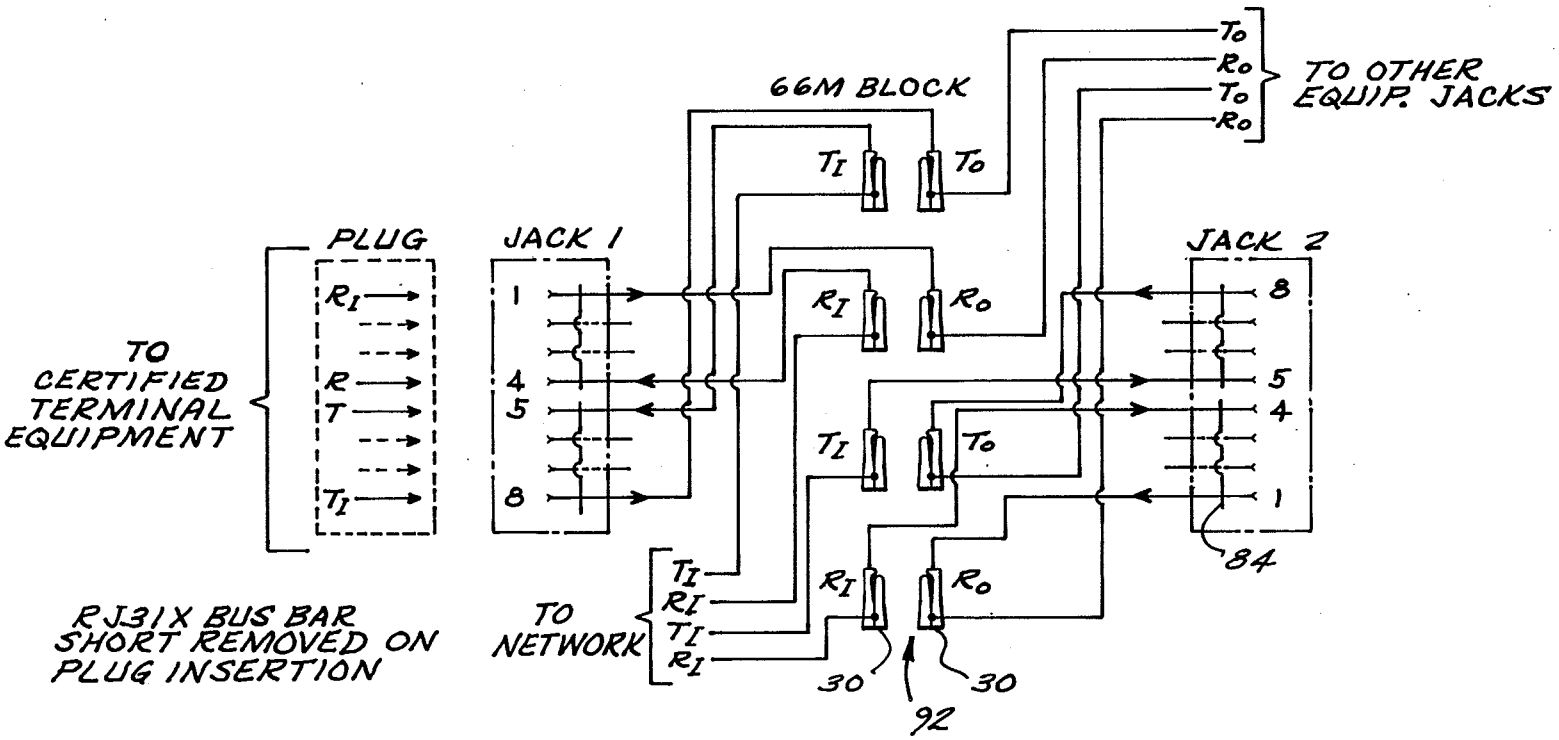
FIG. 12 is a wiring diagram for the dual test plug adapter of FIG. 1.

In FIG. 12, a wiring schematic is shown of the circuit formed by the dual modular adapter of this invention. While the adapter is not in use (e.g. no modular plugs are plugged into modular jack ports 38), bus bars 84 complete the circuit and create a bridge between terminal columns 92. However, when a modular jack is inserted into the adapter such as shown at 86 in FIG. 10, the spring activated rods 68 will be biased and move out of contact with bus bars 84. As a result, plug 86 will break the bus bar 84 connection and transfer current through the particular test equipment to which the plug is attached.

Figure 11:
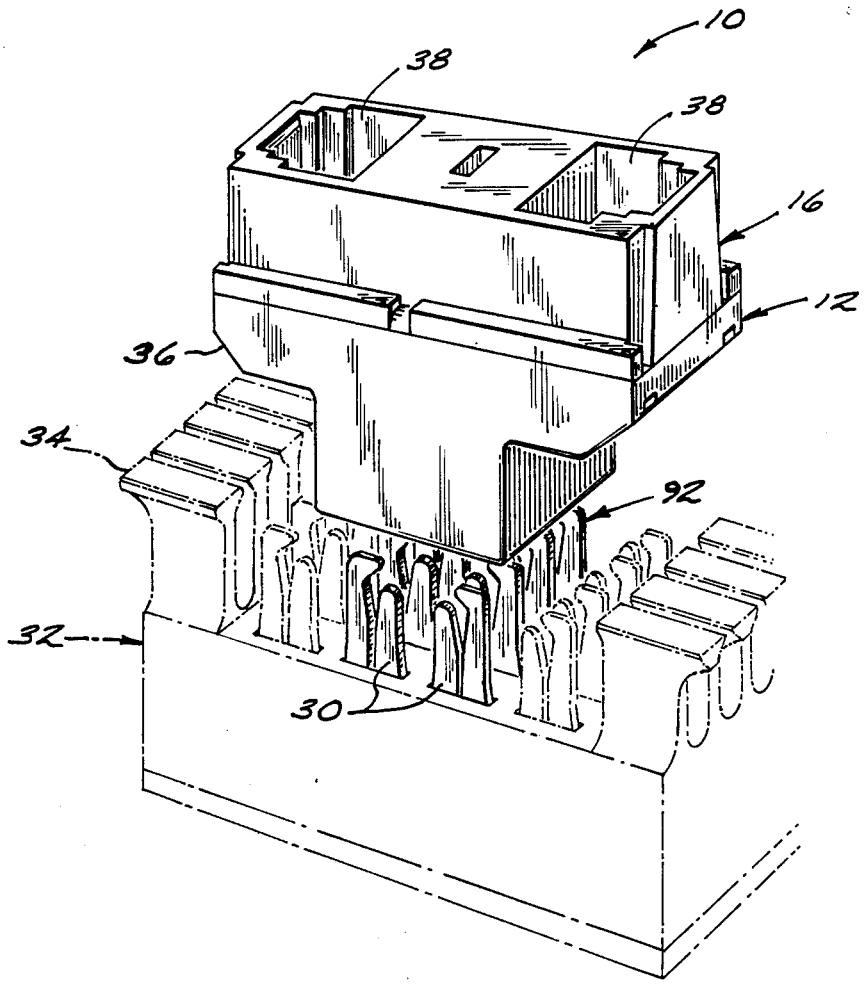
FIG. 11 is a rear perspective view of the dual modular jack adapter of FIG. 1 prior to insertion onto a terminal connecting block.

FIG. 11 represents a dual plug adapter 10 just prior to placement onto terminal block 32. It is shown that adapter 10 encompasses two columns of terminals 92. Also shown is the depth of nose 22 relative to the height of terminals 92 and terminal block fanning strip 34. It will be appreciated that the depth of nose 22 is such that base 24 is elevated above terminals 92 and the terminal block fanning strip 34.

Dual modular jack adapter 10 of the present invention provides many features and improvements relative to the prior art. The adapter 10 is easily and rapidly employed onto a type 66 terminal block 32 or any other similar quick connect block. Also, the present invention will connect with two parallel columns of terminals 92 for either parallel or series connections of auxiliary equipment to block 32. This saves a significant amount of time relative to prior art adapters which have only a single modular plug. The present invention can also be used as a bridging adapter which provides easy access and removability as well as good insulation between terminals. While in place on the block, the adapter 10 is frictionally attached to clips 30 in eight places. The adapter 10 will not fall off the terminal block allowing a service technician to install the unit for long or short term use. The adapter of the present invention is easily assembled, since all of the component pieces can be snapped together alleviating the need for special tools and fasteners.

An important application of the present invention is as a break test bridging adapter. It will be appreciated that the present invention comprises a novel combination of known modular jacks and bus bar bridging means in a plug-on device to define an adapter that plugs onto field installed 66-type terminal blocks and permits break test bridging. In the prior art, it is known to provide break testing means as an integral part of a terminal block. However, the provision of break testing on the block leads to high cost terminal blocks. The present invention allows the user to provide a break test feature for selected circuits on the same low cost block used for circuits that do not require that function.

While preferred embodiments have been shown and described, various modifications and substitutions may be made thereto without departing from the spirit and scope of the invention. Accordingly, it is to be understood that the present invention has been described by way of illustrations and not limitations.

What is claimed is:

1. A dual modular test adapter which is adapted to electrically and mechanically connect onto two or more parallel columns of terminals extending from a communications terminal block, comprising:

an insulative housing having an interior and an exterior, said housing having at least two parallel and adjacent rows of apertures, said apertures communicating between said housing exterior and said housing interior, each of said apertures leading to a cavity in said housing interior;

a plurality of connector clip means, one each of said clip means being disposed in one each of said cavities, said connector clip means being adapted to effect electrical and mechanical connection with a terminal from a terminal block;

a pair of modular jack means, said pair of modular jack means being retained within said housing and communicating between said housing interior and said housing exterior, said modular jack means having contact pins therein;

a plurality of conductor means in said housing, one each of said conductor means being electrically connected between one each of said connector clip means and one each of said contact pins of said modular jack means; and insulating connector clip carrier means, said carrier means being disposed within said housing interior, said carrier means having a plurality of cells which in conjunction with said housing define said cavities for each of said connector clip means.

2. The adapter of claim 1 wherein:

said housing is comprised of separable first and second sections, said apertures being located in said first section and said pair of modular jack means being located in said second section.

3. The adapter of claim 2 including:

attachment means for mating said first and second housing sections.

4. The adapter of claim 3 wherein:

said attachment means comprise hook means extending from one of said housing sections and shoulder means on the other of said housing sections.

5. The adapter of claim 1 wherein said housing includes:

a base section; and a nose section, said apertures being positioned in said nose section.

6. The adapter of claim 1 wherein said carrier means includes:

a central divider wall; and a plurality of walls perpendicular to said central divider walls.

7. The adapter of claim 1 including:

snap action mounting means for attaching said connector clip carrier means to said housing.

8. The adapter of claim 1 including:

bus bar means communicating between said conductor means and said modular jack pins wherein said bus bar means electrically connects two adjacent columns of terminals extending from a communications terminal block.

9. The adapter of claim 8 wherein:

said bus bar means are U-shaped and including:

clip means in said housing means for retaining said bus bar means.

10. The adapter of claim 8 wherein:

said contact means are disconnected from said bus bar means upon entry of a modular plug in said modular jack connecting means.

11. The adapter of claim 1 wherein:

said apertures comprise two rows with four apertures in each row.

12. The adapter of claim 1 wherein:

said housing means has a front face and a rear face and wherein:

said apertures are positioned on said front face; and said modular jack means are positioned on said rear face.

13. The adapter of claim 12 wherein:

at least a portion of said modular jack means are formed as an integral part of said housing means.

14. The adapter of claim 1 wherein:

each of said connector clip means comprises a U-shape female connector having a base with two arm extending therefrom.

15. The adapter of claim 14 wherein each of said cells of said carrier means includes a groove for receiving said conductor means and including:

at least one insulation stripping slot in said base of said connector clip means, said stripping slot communicating with said groove in said cell.

16. The adapter of claim 14 including:

an alignment post in each of said cavities for receiving and frictionally retaining a female connector.

17. The adapter of claim 14 wherein:

each of said cavities has a shape commensurate with the shape of said female connector clips.

18. The adapter of claim 1 wherein:

said connector clip means all have an identical configuration and size.

19. A dual modular test adapter which is adapted to electrically and mechanically connect onto two or more parallel columns of terminals extending from a communication terminal block, comprising:

an insulative housing having an interior and an exterior, said housing having at least two parallel and adjacent rows of apertures, said apertures communicating between said housing exterior and said housing interior, each of said apertures leading to a cavity in said housing interior;

a plurality of connector clip means, one each of said clip means being disposed in one each of said cavities, said connector clip means being adapted to effect electrical and mechanical connection with a terminal from a terminal block;

a pair of modular jack means, said pair of modular jack means being retained within said housing and communicating between said housing interior and said housing exterior, said modular jack means having contact pins therein, said modular jack means being mutually aligned in the same plane and having opposed orientations, said housing means having a front face and a rear face wherein said apertures are positioned on said front face and said modular jack means are positioned on said rear face; and a plurality of conductor means in said housing, one each of said conductor means being electrically connected between one each of said connector clip means and one each of said contact pins of said modular jack means.

20. The adapter of claim 19 wherein:

said connector clip means all have an identical configuration and size.

21. A dual modular test adapter which is adapted to electrically and mechanically connect onto two or more parallel columns of terminals extending from a communications terminal block, comprising:

an insulative housing having an interior and an exterior, said housing having at least two parallel and adjacent rows of apertures, said apertures communicating between said housing exterior and said housing interior, each of said apertures leading to a cavity in said housing interior;

a plurality of connector clip means, one each of said clip means being disposed in one each of said cavities, said connector clip means being adapted to effect electrical and mechanical connection with a terminal from a terminal block;

a pair of modular jack means, said pair of modular jack means being retained within said housing and communicating between said housing interior and said housing exterior, said modular jack means having contact pins therein;

a plurality of conductor means in said housing, one each of said conductor means being electrically connected between one each of said connector clip means and one each of said contact pins of said modular jack means; and bus bar means communicating between said conductor means and said modular jack pins, said bus bar means electrically connecting two adjacent columns of terminals extending from a communications terminal block.

22. The adapter of claim 21 wherein:

said bus bar means are U-shaped and including:

clip means in said housing means for retaining said bus bar means.

23. The adapter of claim 21 wherein:

said contact means are disconnected from said bus bar means upon entry of a modular plug in said modular jack connecting means.

* * * * *